United States Patent [19]

Cunningham

[11] 4,109,484

[45] Aug. 29, 1978

[54] THERMAL PROTECTIVE BARRIER FOR OPEN REFRIGERATED COMPARTMENT

[75] Inventor: William E. Cunningham, San Carlos, Calif.

[73] Assignee: Sullivan Company, San Francisco, Calif.

[21] Appl. No.: 773,930

[22] Filed: Mar. 3, 1977

[51] Int. Cl.[2] ..... A47F 3/04; A47H 23/00; A47H 3/00; A47H 15/00

[52] U.S. Cl. ..... 62/256; 160/354; 160/368 S

[58] Field of Search ..... 62/255, 256; 312/116; 24/217; 160/354, 368 S, 179, 231 A, 369, 368 R

[56] References Cited

U.S. PATENT DOCUMENTS

| | | | |
|---|---|---|---|
| 2,014,590 | 9/1935 | Sanders | 62/256 |
| 3,186,185 | 6/1965 | Bently et al. | 62/256 |
| 3,241,899 | 3/1966 | Donker | 62/255 |
| 3,403,525 | 10/1968 | Beckwith et al. | 62/256 |
| 3,465,536 | 9/1969 | Vogel et al. | 62/256 |
| 3,496,732 | 2/1970 | Vogel et al. | 62/256 |
| 3,916,756 | 11/1975 | Yoda | 24/217 R |

*Primary Examiner*—Lloyd L. King
*Attorney, Agent, or Firm*—Flehr, Hohbach, Test, Albritton & Herbert

[57] ABSTRACT

Means forming a thermal protective barrier for inhibiting the transfer of energy between the environs and an open refrigerated compartment or bin during limited periods of inactivity has been provided by a pliant panel sufficiently extensive to cover the opening of the compartment. The panel is readily fastenable to an edge margin of the freezer compartment so that it can be draped across the open compartment. The panel comprises sections readily releasably secured together in sections to be easily removed for selective access to limited portions of the freezer compartment and for easy handling and storage of the sections. The closure panel is constructed whereby condensation accumulates on the exterior surface while a thermal barrier layer lies protected from condensate on the internal surface.

5 Claims, 5 Drawing Figures

FIG_1
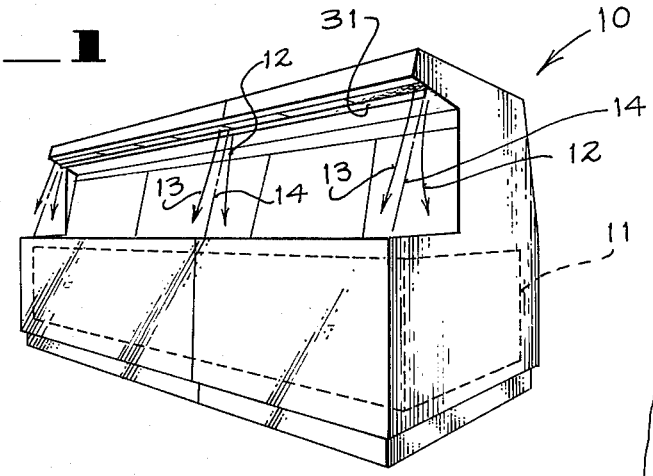
FIG_3
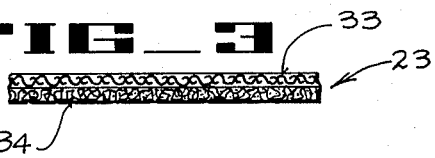
FIG_5
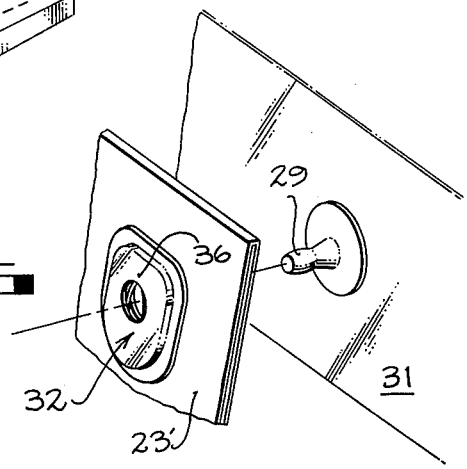
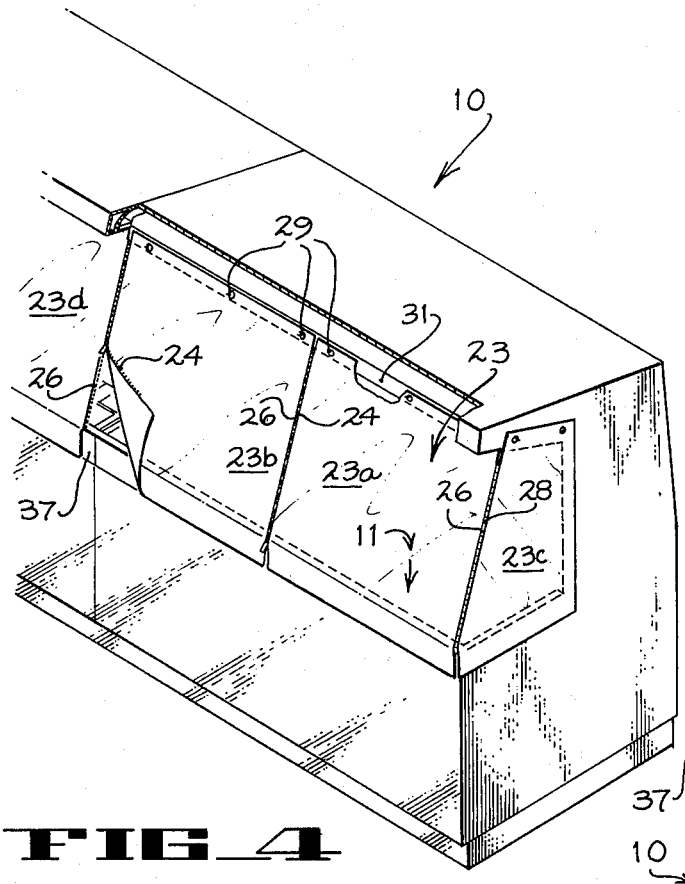
FIG_4
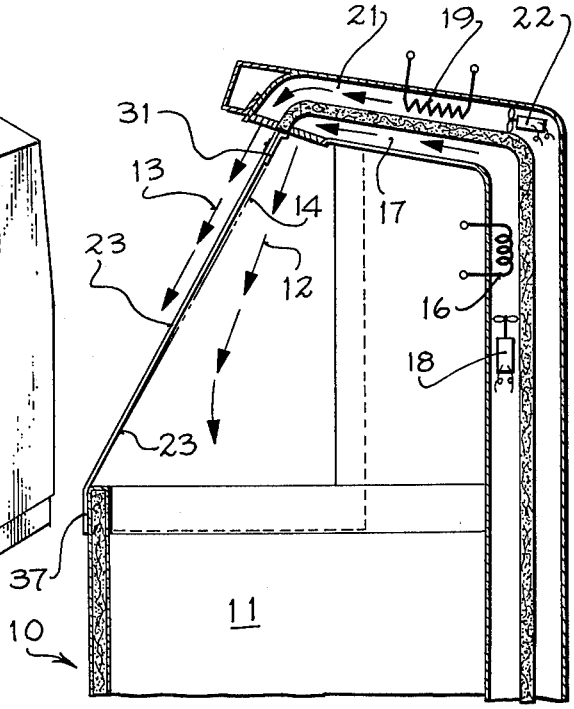
FIG_2

THERMAL PROTECTIVE BARRIER FOR OPEN REFRIGERATED COMPARTMENT

BACKGROUND OF THE INVENTION

This invention pertains to a thermal barrier and more particularly to a thermal closure for readily covering the access opening of a refrigerated bin or compartment for inhibiting the transfer of energy between the environs and the compartment during limited periods of inactivity, such as at night when the compartment is not being used by customers.

It has been observed that in the operation of refrigerated freezers, dairy cases and beverage coolers of the type found in super markets for example, of a type having a fully open top or side for access to frozen foods, dairy products and the like contained therein, in order to be able to maintain the foods in a properly refrigerated condition, the refrigerating elements operate continuously 24 hours a day. Continued operation constitutes an inordinate expense and wasteful use of energy. Accordingly, there is a need for the provision of some means for minimizing the consumption of energy without undue warming of the food products in the compartment.

As disclosed herein consumption of energy is significantly reduced while continuing operation even through periods of customer inactivity by installing a light weight thermal protective barrier for inhibiting transfer by energy from the environs to the open compartment.

One unsuccessful suggestion has been to provide a window-shade like device on a roller adapted to permit the shade to be drawn across the open top of the freezer. This suggestion, however, suffers from certain limitations including difficulties in obtaining a sufficient thermal shield as well as the inconvenience of attaching the free end edge of the shade.

SUMMARY OF THE INVENTION AND OBJECTS

In general, a thermal protective barrier for inhibiting the transfer of energy between the environs and an open refrigerated compartment during limited periods of inactivity, such as at night when the store is closed, includes pliant panel means sufficiently extensive to cover the access opening of the compartment. The panel means includes one or more segments no one of which is greater than can be easily handled and folded by an individual for storage. Readily releasable fastening means carried by an edge margin of the panel means cooperates and engages fastening means carried along an edge margin of the compartment so as to permit engagement and mounting of the thermal barrier to be draped across and cover the open compartment. The panel means comprises an outer layer of pliant material substantially impervious to water and a layer of thermal insulating material carried on the inner face of the layer of impervious material.

BRIEF DESCRIPTION OF THE DRAWINGS

FIG. 1 shows a diagrammatic perspective view of a refrigerated food compartment of known construction;

FIG. 2 shows an enlarged elevation section view of a portion of FIG. 1.

FIG. 3 shows an elevation section view of a portion of a thermal barrier according to the invention;

FIG. 4 shows a diagrammatic perspective view of a thermal barrier installed on a freezer, according to the invention;

FIG. 5 shows a diagrammatic enlarged detail view of fastening means.

DETAILED DESCRIPTION OF PREFERRED EMBODIMENT

A typical refrigerated super market food display 10 includes a broad horizontal compartment 11 open at the top and readily accessable to customers in removing the contents thereof. For normal daytime operations means are provided for maintaining the low temperature within compartment 11 by projecting a stream 12 of cold air downwardly onto the top of products within compartment 11. At the same time a stream 13 of warm air is projected laterally outwardly of stream 12 to pass across the edge of compartment 11. The two streams, 12, 13 are diagrammatically separated by the phantom line 14 for purposes of illustration. It has been observed that the provision of an overlying layer of warm air serves to direct and contain the stream of cold air in position to be applied directly to the contents of compartment 11.

Suitable means for providing the foregoing effects have been shown in the diagram in FIG. 2 wherein a cooling coil 16 has been disposed within an air channel 17 while an electric fan 18 serves to supply air to pass across coil 16 to be discharged as the cold air stream 12.

Means providing a warm air stream comprises, for example, a heating coil or other heating element 19 disposed within an air channel 21 whereby another fan 22 serves to provide a stream of air blowing across element 19 to be warmed and discharged as the warm air stream 13.

Accordingly, as diagrammatically indicated, the phantom line 14 indicates a separation of the two air streams. As noted above, it has been observed that by providing the warm external air stream relative to the cold internal air stream, the internal air stream is substantially retained for purposes of cooling merchandise in compartment 11.

It is readily evident, however, that during limited periods of inactivity, such as after the store has closed in the evening, continued full operation of the system serves to consume considerable energy in an effort to prevent warming and spoiling of the food products.

As shown in FIG. 4 a thermal barrier 23 can be readily installed at closing time substantially along the plane represented by line 14 for inhibiting the transfer of energy from the environs to the open refrigerated compartment 11 to minimize the energy consumption during such limited periods of inactivity.

Barrier 23 comprises pliant panel means sufficiently extensive to be draped across and cover the opening of compartment 11. The panel means comprises a plurality of panel sections **23*a*, 23*b*, 23*c*, 23*d* no one of which is greater than can be easily handled and folded by an individual for minimum storage. Means carried by the sections serve to couple the sections together to form a sufficiently enlarged panel to extend across and close the opening of compartment 11** while permitting the sections to be easily removed individually for access to limited portions of the freezer compartment.

Thus, panel sections **23*a* and 23*b* are each characterized by one half of cooperating fastening means such as one half 24, 26 of a zipper disposed along opposite sides thereof for cooperation with complimentary zipper halves. Zipper halves 27, 28 carried along an edge of end flap sections 23***c*, 23*d* engage zipper halves 24, 26.

An upper edge margin 31 of display 10 carries readily releasable fastening means such as the studs 29 for cooperation with fastening means such as the annular snap-on fastener device 32 carried by a reinforced upper edge margin 23' of the panel forming the thermal barrier 23.

Thermal barrier 23 comprises a pliant layer 33 of substantially impervious material and a layer 34 of thermal insulating material carried on the inner face of the impervious layer 33, i.e. on the face confronting the refrigerated zone.

It has been observed that a suitable impervious outer layer 33 has been provided employing vinyl coated or laminated fabric of polyamides or polyesters. While the inner insulating layer can readily be provided by application of a layer of felt blanket, wool, modacrylics or polyester fibers woven or felted. Also unsupported vinyl or ribbon woven polyethylene or polypropylene coated on one side with polyurethane may be employed.

Fastener device 32 is of known stype incorporating spreadable opposed spring elements 36.

In operation, thermal barrier 23 can be quickly snapped onto the fastening devices 29 while permitting the lower edge margin to drape across the lower edge of the freezer bin or compartment. This type of mounting arrangement has the advantage that it is not necessary for a store clerk to do anything more than merely lift the lower edge of skirt 37 to obtain or put away a few items of merchandise after barrier 23 has been attached.

From the foregoing it will be readily evident that there has been provided an improved thermal barrier which is readily attachable along a single edge to be draped to form a temporary closure for a refrigerated compartment during limited periods of inactivity so as to limit the energy required to maintain a suitable temperature within compartment 11. Condensation will, to a limited degree perhaps accumulate on the exterior surface of the impervious layer 33 so as to permit the thermal insulating layer 34 to remain isolated from the condensate.

I claim:

1. A thermal barrier for inhibiting the transfer of energy between the environs and an open refrigerated compartment during limited periods of inactivity comprising pliant panel means sufficiently extensive to cover the opening of said compartment, readily releasable fastening means disposed along an edge margin of said compartment, fastening means carried by an edge margin of said panel means for cooperation and engagement with the first named fastening means to retain said panel means disposed to extend across and close said compartment, said panel means comprising a layer of substantially impervious pliant material and a layer of thermal insulating material carried on the inner face of said impervious material.

2. A thermal barrier according to claim 1 in which said panel means comprises a plurality of segments no one of which is greater than can be easily handled and folded by an individual for compact storage, and means carried by said segments for coupling said segments together to form a sufficiently enlarged panel to close said opening while permitting said segments to be removed individually for limited access to selected portions of said compartment.

3. A thermal barrier for inhibiting the transfer of energy from the environs to an open refrigerated compartment during limited periods of inactivity comprising pliant panel means sufficiently extensive to cover the opening of said compartment, readily releasable fastening means carried by an edge margin of said panel means for cooperation and engagement with fastening means disposed along an edge margin of said compartment to dispose said panel means to be draped across and to close said compartment; said panel means comprising a layer of substantially impervious pliant material and a thermal insulating layer of material carried on the inner face of said layer of pliant material.

4. A thermal barrier according to claim 3 in which said panel means comprises a plurality of sections, and means carried by said sections for coupling said sections together to form a sufficiently enlarged panel to close said opening while permitting said sections to be removed individually for limited access to selected portions of said freezer compartment.

5. A thermal barrier according to claim 4 in which said means for coupling said panel sections together comprises coupling means between each adjacent pair of panel sections.

* * * * *